US007121958B2

(12) United States Patent
Cheng et al.

(10) Patent No.: US 7,121,958 B2
(45) Date of Patent: Oct. 17, 2006

(54) POSITIONING STRUCTURE IN A GOLF CLUB HEAD

(75) Inventors: Bernard Cheng, Kaohsiung (TW); Anita Chen, Kaohsiung (TW); Sasamoto Akinori, Kaohsiung (TW); May Lin, Fengshan (TW)

(73) Assignee: Advanced International Multitech Co., Ltd., Kaohsiung (TW)

( * ) Notice: Subject to any disclaimer, the term of this patent is extended or adjusted under 35 U.S.C. 154(b) by 7 days.

(21) Appl. No.: 10/871,639

(22) Filed: Jun. 17, 2004

(65) Prior Publication Data

US 2004/0266548 A1 Dec. 30, 2004

(30) Foreign Application Priority Data

Jun. 27, 2003 (TW) ..... 92211771 U

(51) Int. Cl.
*A63B 53/04* (2006.01)

(52) U.S. Cl. ..... 473/345; 473/350; 473/342

(58) Field of Classification Search ..... 473/324–350
See application file for complete search history.

(56) References Cited

U.S. PATENT DOCUMENTS

| | | | | |
|---|---|---|---|---|
| 6,350,209 | B1 * | 2/2002 | Chen | 473/342 |
| 6,458,045 | B1 * | 10/2002 | Chen | 473/342 |
| 6,506,129 | B1 * | 1/2003 | Chen | 473/329 |
| 6,749,524 | B1 * | 6/2004 | Chen | 473/342 |
| 6,841,014 | B1 * | 1/2005 | Huang et al. | 148/608 |
| 2003/0054901 | A1 * | 3/2003 | Sun | 473/342 |

* cited by examiner

*Primary Examiner*—Eugene Kim
*Assistant Examiner*—Alvin A. Hunter, Jr.
(74) *Attorney, Agent, or Firm*—James H. Walters

(57) ABSTRACT

A golf club head includes a head body having a recessed area defined in a central area of the head body and abutting faces formed along a periphery defining the recessed area. A soldering seam is formed on an outer periphery defining the recessed area and at least one positioning block is formed on one of the abutting faces and has a bottom face flush with a top face of the recessed area. A striking face is abutted to the abutting faces and the bottom face of the positioning block to allow the soldering seam to securely combine the head body and the striking face.

3 Claims, 5 Drawing Sheets

POSITIONING STRUCTURE IN A GOLF CLUB HEAD

BACKGROUND OF THE INVENTION

1. Field of the Invention

The present invention relates to a positioning structure, and more particularly to positioning structure in a golf club head to facilitate the mating between the head body and the striking face so that the welding process is shortened.

2. Description of Related Art

A golf club head usually is composed of different parts welded together. With reference to FIG. 7, a conventional the conventional golf club head is composed of a head body (40) and a striking face (41). The striking face (41) has a flange (411) formed on a peripheral edge of the striking face (41) to abut a peripheral edge of the head body (40). After the flange (411) of the striking face (41) is abutted the peripheral edge of the head body (40), a solder fillet (42) is formed between a joint between the flange (411) of the striking face (41) and the peripheral edge of the head body (40).

During the mating process between the head body (40) and the striking face (41), because there is no positioning structure in either the head body (40) or the striking face (41), the operator's visual inspection is the only means to complete the positioning work between the head body (40) and the striking face (41) and thus the rate of defective products is high. Furthermore, the solder fillet (42) formed on the joint between the flange (411) of the striking face (41) and the peripheral edge of the head body (40) requires a post-polishing process after the golf club head is finished, which is time consuming and labor inefficient.

To overcome the shortcomings, the present invention tends to provide an improved positioning structure to mitigate the aforementioned problems.

SUMMARY OF THE INVENTION

The primary objective of the present invention is to provide an improved positioning structure between the golf head body and the striking face to precisely mate the head body with the striking face.

Another objective of the present invention is to provide a soldering seam along a periphery of a recessed area defined in the head body so that when the striking face is mated with the head body along the periphery of the head body, the soldering seam is welded to securely combine the periphery of the recessed area of the head body and the periphery of the striking face. Thus, the post-polishing work involved with the finished golf club head is minimal.

Other objects, advantages and novel features of the invention will become more apparent from the following detailed description when taken in conjunction with the accompanying drawings.

DETAILED DESCRIPTION OF THE PREFERRED EMBODIMENT

Figure 1:
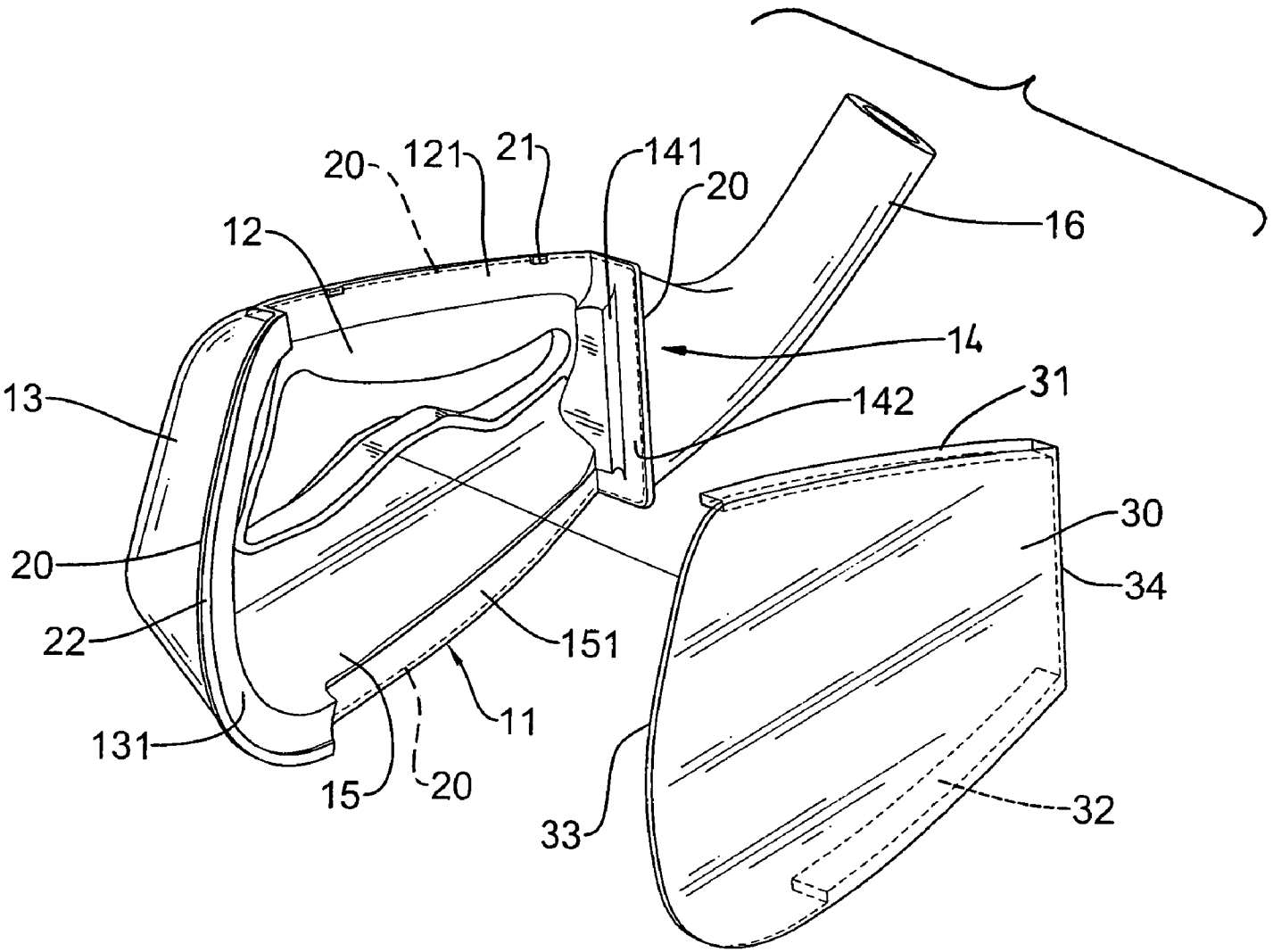
FIG. 1 is an exploded perspective view of the head body and the striking face.

With reference to FIG. 1, the golf club head in accordance with the present invention has a head body (10) and a striking face (30).

The head body (10) has a recessed area (11) defined in a central area of the head body (10), a rear plate (12), a first side plate (13), a second side plate (14) opposite to the first side plate (13), a bottom plate (15) and a neck (16) The rear plate (12) forms a bottom face defining the recessed area (11) and has a rear plate abutting face (121) at a top edge of the rear plate (12) The first side plate (13) is arcuate and integrally formed with the rear plate (12) and has a first side plate abutting face (131) at a free edge of the first side plate (13) The second side plate (14) is integrally formed with the rear plate (12) and has a second side plate abutting face (141) formed adjacent to a free edge of the second side plate (14) and a flat face (142) sandwiched between the free edge of the second side plate (14) and the second side plate abutting face (141) The bottom plate (15) is integrally formed with the rear plate (12) and has a rear plate abutting face (151) along a free edge of the bottom plate (15)

A soldering seam (20) is formed on an outer periphery defining the recessed area (11) That is, the soldering seam (20) is formed along outer peripheries of the rear plate (12), the first side plate (13), the second side plate (14) and the bottom plate (15) Furthermore, at least one (two are shown in this embodiment) positioning block (21) is formed on a side face of the soldering seam (20) located along the outer periphery of the rear plate abutting face (121) and has a bottom face flush with the top edge of the rear plate abutting face (121) of the rear plate (12) A side flange (22) is formed along a side face of the soldering seam (20) located along the outer periphery of the first side plate abutting face (131).

The striking face (30) has a top ledge (31) formed on a top periphery of the striking face (30) to correspond to the rear plate abutting face (121), a bottom ledge (32) formed on a bottom periphery of the striking face (30) to correspond to the bottom plate abutting face (151), an arcuate side face (33) formed on a periphery of the striking face (30) to correspond to the first side plate abutting face (131) and a vertical side face (34) formed on a periphery of the striking face (30) to correspond to the second side plate abutting face (141).

Figure 2:
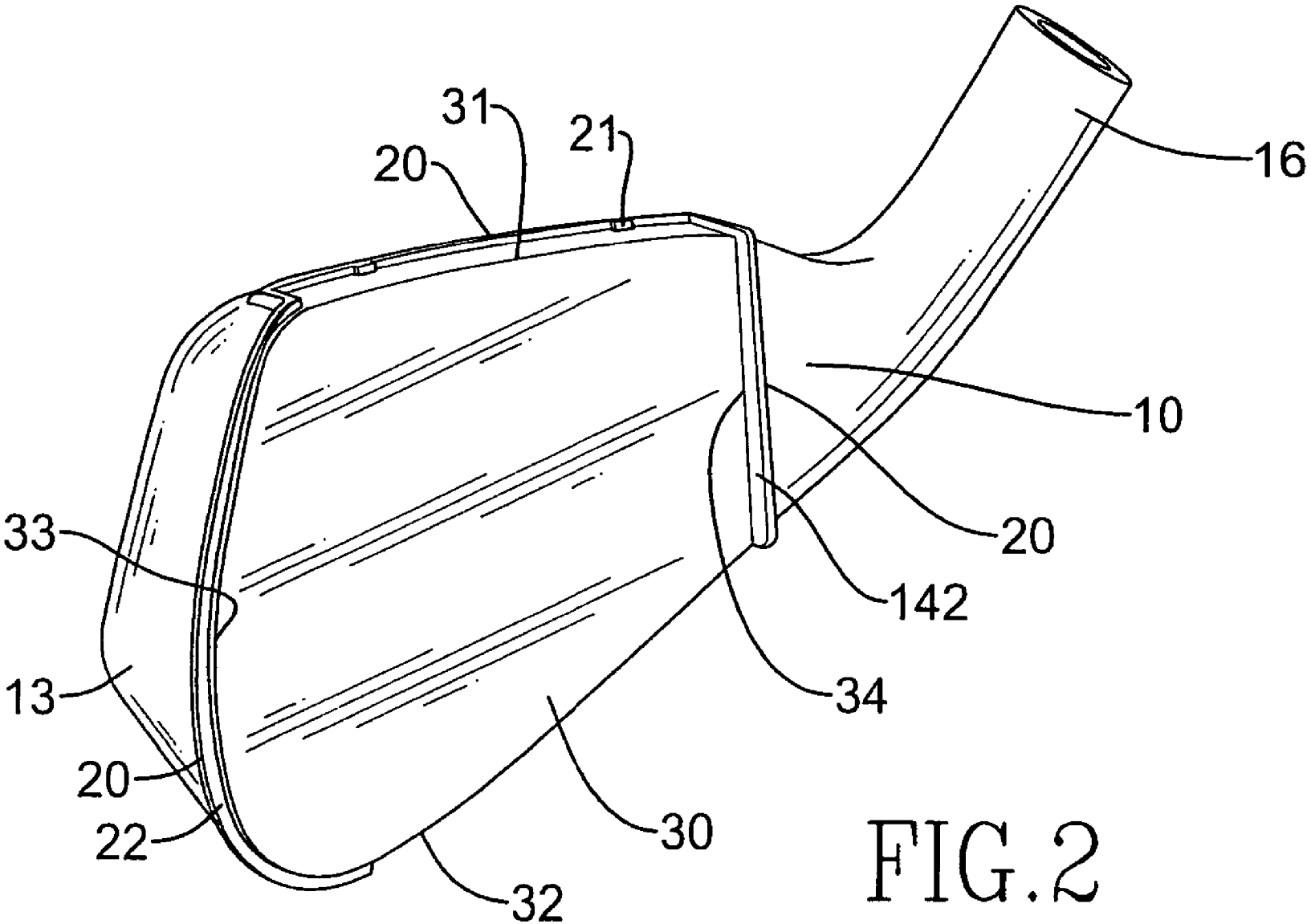
FIG. 2 is a perspective view of the combination of the head body and the striking face.
Figure 4:
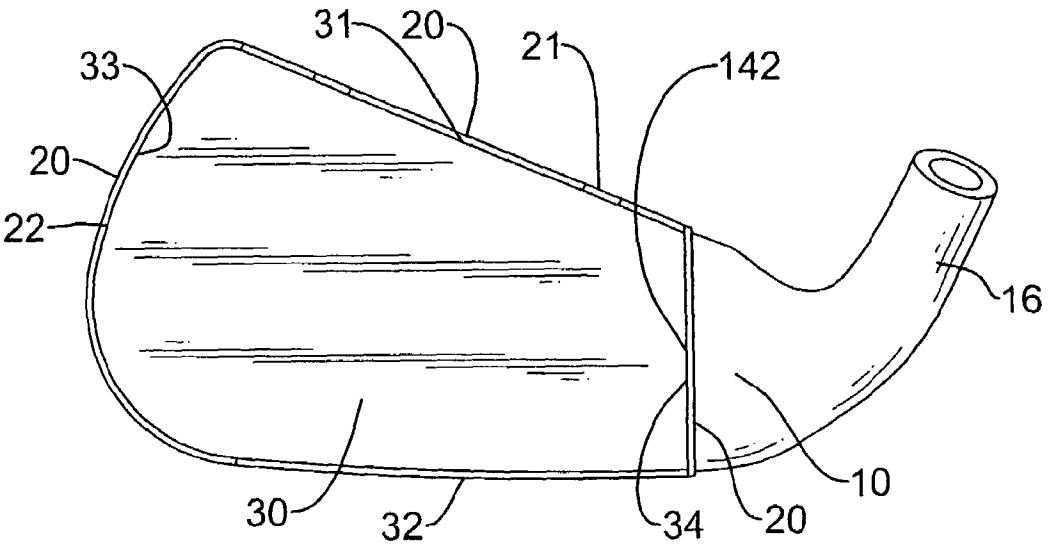
FIG. 4 is a side plan view of the combined golf club head.
Figure 3:
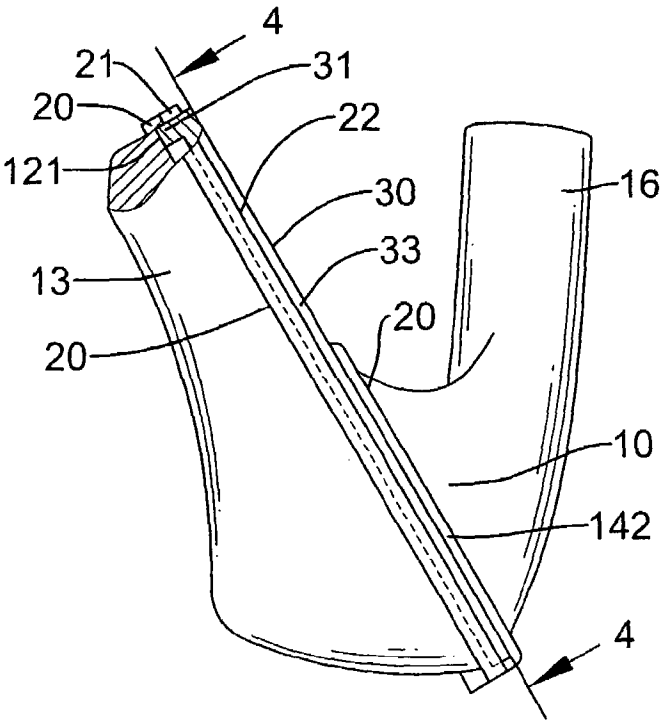
FIG. 3 is a perspective view of the combined golf club head in partial cross section.
Figure 6:
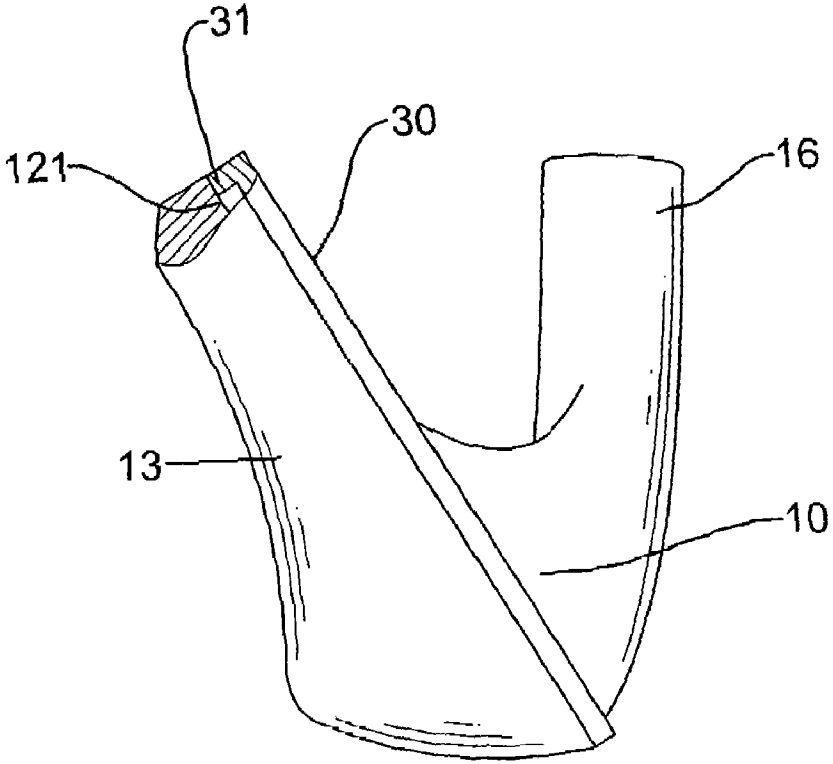
FIG. 6 is a perspective view with partial in cross section of the combined golf club head in FIG. 5 after the solder seam is polished.
Figure 5:
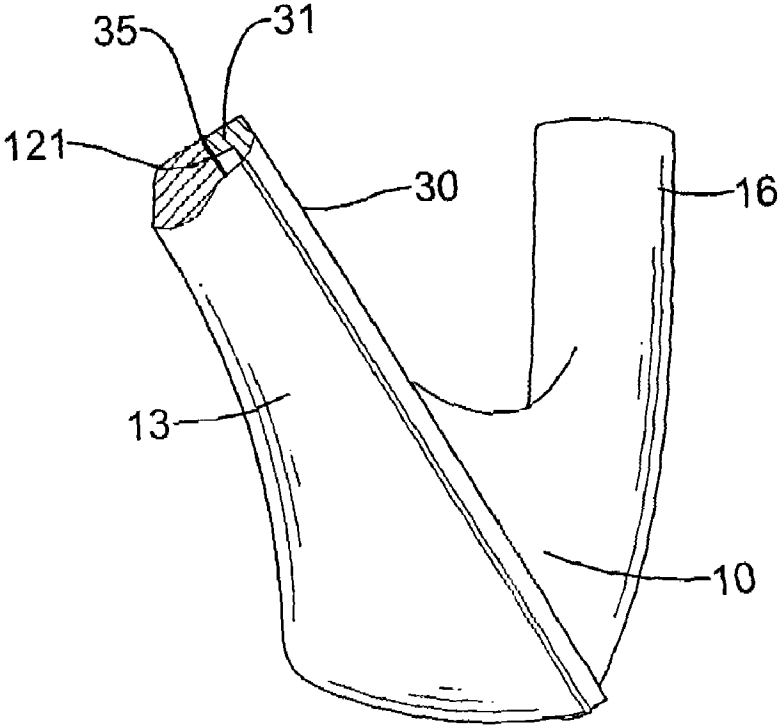
FIG. 5 is a perspective view of the combined golf club head in partial cross section after the soldering seam is welded.
Figure 7:
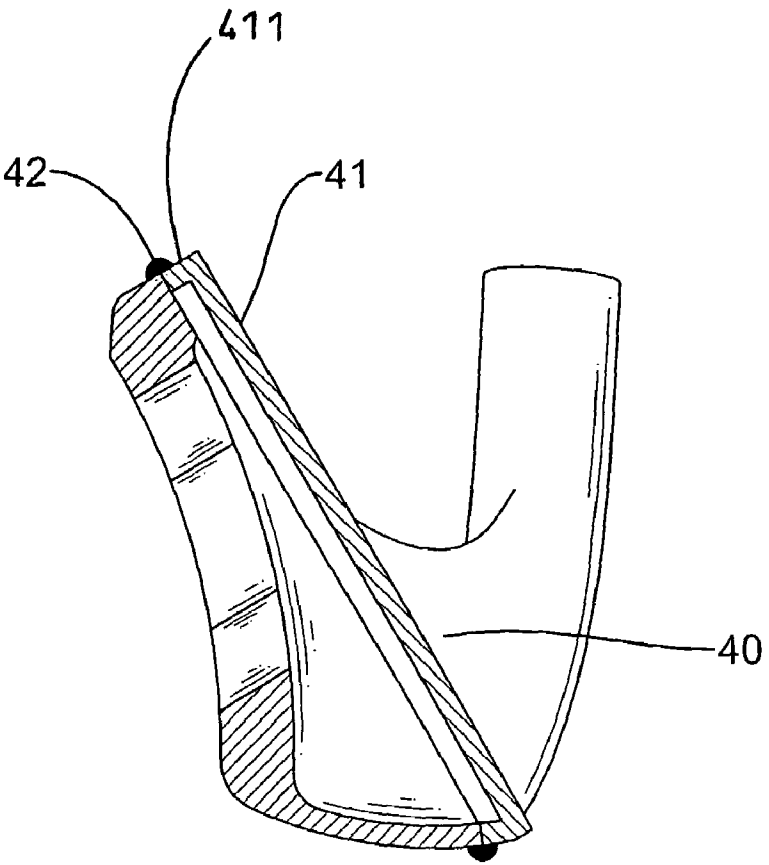
FIG. 7 PRIOR ART
FIG. 7 is a cross sectional view showing a conventional golf club head.

With reference to FIGS. 2, 3 and 4, when the head body (10) and the striking face (30) are combined, it is noted that the top ledge (31) is abutted to the rear plate abutting face (121) with the positioning block (21) abutting a top face of the top ledge (31), the bottom ledge (32) is abutted to the bottom plate abutting face (151), the arcuate side face (33) is abutted to the first side plate abutting face (131) and the vertical side face (34) is abutted to the second plate abutting face (141). As a consequence of the bottom face of the positioning block (21) being flush with the top periphery of the rear plate abutting face (121), the flat face (142) being extended out from the second plate abutting face (141) and the side flange (22) being extended out of the first side plate abutting face (131), the periphery of the striking face (30) is substantially enclosed by the head body (10). Because the vertical side face (34) is abutted to the second side plate abutting face (141) and stopped by the flat face (142), the arcuate side face (33) is abutted to the first side plate abutting face (131) and stopped by the side flange (22) and the top ledge (31) is stopped by the positioning block (21), the positioning of the striking face (30) to the head body (10) is easy and accurate.

After the striking face (30) is positioned in relation to the head body (10), the operator is able to weld the soldering seam (20) along the joint between the striking face (30) and the head body (10). Because the soldering seam (20) is formed on an outer periphery defining the recessed area (11) of the head body (10), after the soldering seam (20) is melted, the height of the soldering seam (20) is reduced and thus the post-polishing process to finish the product of the combination between the head body (10) and the striking face (30) is easy.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A golf club head comprising:

a head body having a recessed area defined in a central area of the head body and abutting faces formed along a periphery defining the recessed area, a soldering seam formed on an outer periphery defining the recessed area and at least one positioning block formed on one of the abutting faces and having a bottom face flush with a top face of the recessed area; and a striking face abutted to the abutting faces and the bottom face of the positioning block to allow the soldering seam to securely combine the head body and the striking face, wherein the head body includes a rear plate, a first side plate, a second side plate opposite to the first side plate, a bottom plate and a neck;

the rear plate forms a bottom face defining the recessed area and has a rear plate abutting face at a top edge of the rear plate;

the first side plate is arcuate and integrally formed with the rear plate and has a first side plate abutting face at a free edge of the first side plate;

the second side plate is integrally formed with the rear plate and has a second side plate abutting face formed adjacent to a free edge of the second side plate and a flat face sandwiched between the free edge of the second side plate and the second side plate abutting face; and the bottom plate is integrally formed with the rear plate and has a rear plate abutting face along a free edge of the bottom plate, wherein the first side plate further has a side flange extending out of the first side plate abutting face to abut a side periphery of the striking face.

2. The golf club head as claimed in claim 1, wherein the striking face includes a top ledge formed on a top periphery of the striking face to correspond and abut to the rear plate abutting face, a bottom ledge formed on a bottom periphery of the striking face to correspond and abut to the bottom plate abutting face, an arcuate side face formed on a periphery of the striking face to correspond and abut to the first side plate abutting face and a vertical side face formed on a periphery of the striking face to correspond and abut to the second side plate abutting face.

3. A golf club head comprising:

a head body having a recessed area defined in a central area of the head body and abutting faces formed along a periphery defining the recessed area, a soldering seam formed on an outer periphery defining the recessed area and at least one positioning block formed on one of the abutting faces and having a bottom face flush with a top face of the recessed area; and a striking face abutted to the abutting faces and the bottom face of the positioning block to allow the soldering seam to securely combine the head body and the striking face, wherein the head body includes a rear plate, a first side plate, a second side plate opposite to the first side plate, a bottom plate and a neck;

the rear plate forms a bottom face defining the recessed area and has a rear plate abutting face at a top edge of the rear plate;

the first side plate is arcuate and integrally formed with the rear plate and has a first side plate abutting face at a free edge of the first side plate;

the second side plate is integrally formed with the rear plate and has a second side plate abutting face formed adjacent to a free edge of the second side plate and a flat face sandwiched between the free edge of the second side plate and the second side plate abutting face; and the bottom plate is integrally formed with the rear plate and has a rear plate abutting face along a free edge of the bottom plate, wherein the striking face includes a top ledge formed on a top periphery of the striking face to correspond to and abut the rear plate abutting face, a bottom ledge formed on a bottom periphery of the striking face to correspond and abut to the bottom plate abutting face, an arcuate side face formed on a periphery of the striking face to correspond and abut to the first side plate abutting face and a vertical side face formed on a periphery of the striking face to correspond and abut to the second side plate abutting face.

* * * * *